United States Patent [19]

Dittert

[11] Patent Number: 5,000,869

[45] Date of Patent: Mar. 19, 1991

[54] NOVEL POLYMER COATED BLEACHING COMPOSITION

[75] Inventor: Lewis W. Dittert, Lexington, Ky.

[73] Assignee: Safe Aid Products, Inc., Hauppauge, N.Y.

[21] Appl. No.: 480,124

[22] Filed: Feb. 14, 1990

[51] Int. Cl.[5] ..... C11D 7/50

[52] U.S. Cl. ..... 252/174.13; 252/102; 252/186.34

[58] Field of Search ..... 252/174.13, 186.34, 252/102

[56] References Cited

U.S. PATENT DOCUMENTS

| | | |
|---|---|---|
| 3,715,184 | 2/1973 | Kuhling et al. . |
| 3,908,045 | 9/1975 | Alterman et al. . |
| 4,009,113 | 2/1977 | Green et al. . |
| 4,124,734 | 11/1978 | Alterman et al. . . |
| 4,136,052 | 1/1979 | Mazzola . |
| 4,526,699 | 7/1985 | Jones et al. . |
| 4,725,378 | 2/1988 | Krawczak . |
| 4,728,453 | 3/1988 | Choy . |
| 4,741,858 | 5/1988 | Choy et al. . |

FOREIGN PATENT DOCUMENTS

| | | |
|---|---|---|
| 907358 | 10/1962 | United Kingdom . |
| 1204123 | 9/1970 | United Kingdom . |

OTHER PUBLICATIONS

Lea & Febiger, Third Edition (1986), Lachman et al., "The Theory and Practice of Industrial Pharmacy".

Journal of Organic Chemistry, vol. 25 (1959), Slezak et al., "Halogenation of Glycoluril and Diureidopentane".

*Primary Examiner*—A. Lionel Clingman
*Assistant Examiner*—William S. Parks
*Attorney, Agent, or Firm*—Burns, Doane, Swecker & Mathis

[57] ABSTRACT

A fabric-safe bleaching and cleaning detergent composition comprising a bleach stable surfactant and a polymer coated halogenated glycoluril compound having the formula wherein each R is independently selected from hydrogen, $C_1$-$C_{10}$ straight or branched chain alkyl, aryl or alkyl substituted aryl; each X is independently selected from hydrogen, fluorine, chlorine, bromine and iodine and at least one X is not hydrogen and n is 0 or 1. 1,3,4,6-tetrachloroglycoluril is the preferred bleaching agent. The polymer coating is capable of hydrating and dissolving at a pH of greater than 6.0, preferably 7.2 to 11.0, and more preferably 9.5 to 11.0. Polymeric pharmaceutical enteric coating materials are particularly suitable as a coating material for the present invention.

23 Claims, 2 Drawing Sheets

NOVEL POLYMER COATED BLEACHING COMPOSITION

BACKGROUND OF THE INVENTION

1. Field of the Invention

The present invention relates generally to the formulation of a novel bleaching and cleaning composition. In particular, the subject invention is concerned with a detergent composition containing a halogenated glycoluril compound which is coated with a polymer which is able to hydrate and dissolve at a pH greater than 6.0. Pharmaceutically acceptable enteric coating polymers are particularly suitable in the practice of the present invention.

2. Description of the Related Art

It is known to include bleaching agents in cleaning products and in particular in detergent compositions for cleaning fabrics. Conventional bleaching agents include alkali metal hypochlorites, hydrogen peroxide and more recently water soluble peroxide adducts, e.g., alkali metal perborates, percarbonates, perphosphates and persilicates. For instance, chlorine dioxide is also known as a powerful oxidizing agent. Perborates are a popular fabric-safe bleach used at the present time.

It is also known that in the cleaning and bleaching of either colored or white fabrics, it is unsatisfactory to remove the stains from fabrics at the cost of fading the colors or degrading the fibers in the fabric during the bleaching process. Prior to this invention, difficult stains were removed either by repeated washing and bleaching steps or by increasing the concentration of bleach during the laundering process. The use of higher concentrations of bleach runs the risk of damage to the fabric fiber or localized bleaching of color in the fabric.

It has long been known that many compounds which contain a halogen atom in their structure have the possibility of acting as bleaching agent. A wide variety of suitable halogenated bleaching agents are known in the art. For instance, Slezak et al, "Halogenation of Glycoluril and Diuradopentane," *Journal of Organic Chemistry*, Vol. 25, pp. 660–661 (1959) describes several chlorinated glycoluril compounds.

At one time tetrachloroglycoluril was marketed by Diamond Alkali Company, now Diamond Shamrock, as a bleaching and sanitizing agent. It was also used in briquet form as a swimming pool disinfectant. However, the compound was limited by its solubility and commercial interest soon waned. Tetrachloroglycoluril is no longer used as a bleaching or sanitizing agent.

A number of processes are known in the art for coating halogen-containing bleaching or cleaning compounds in an attempt to develop a fabric-safe product. For instance, U.S. Pat. No. 4,725,378 discloses a composition useful for supplying a bleach over a period of time by contacting a polycarboxylic acid, a second polymeric compound and a chlorine-releasing agent under the proper conditions. U.S. Patent No. 3,715,184 suggests coating particles of acylated glycoluril compounds with watersoluble high molecular weight organic substances which are preferably capable of swelling in water.

U.S. Pat. No. 4,009,113 relates to the protection of solid precursors in powder detergent compositions using a hydrogen peroxide bleaching system. The finely divided precursor is formed into a composite particle which is then coated. The coated particle allows good dispersion of the precursor in the wash liquor.

U.K. Patent Specification No. 907,358 discloses coating a precursor, e.g., tetraacylmethylenediamine with a water-soluble material, e.g., a polyethylene glycol. The product is protected from the environment and has a slow rate of dissolution. In U.K. Patent Specification No. 1,204,123, there is described a method of protecting an adjunct in detergent compositions.

U.S. Pat. No. 4,728,453 discloses delayed-release hypohalite bleach compositions which include encapsulates having a granular, hypohalite-releasing core and a coating which delays release of the hypohalite ion and scavenging hypohalite ion when the encapsulates are exposed to an aqueous solution.

U.S. Pat. No. 4,136,052 provides a special coating which encapsulates the bleaching compound. An active chlorinating agent is surrounded by a first non-reactive coating combination of fatty acid and wax. A second coating is applied containing fatty acid with a material exhibiting inverse aqueous solubility with respect to temperature. The outer, second coating is more resistant to dissolution in hot than in cold water.

U.S. Pat. No. 4,741,858 discloses time-release bleaching compounds containing encapsulated hypochlorite bleaching agents. One embodiment includes sodium silicate-coated lithium hypochlorite. U.S. Pat. No. 4,124,734 discloses a fatty acid coating material wherein the fatty acid has 12–20 carbon atoms. U.S. Pat. No. 4,526,699 involves the use of a bleaching composition which consists of an N-halo compound with a coating comprising a silicate bound, hydrated, soluble inorganic salt and an alkali metal salt of boric acid. U.S. Pat. No. 3,908,045 discloses an encapsulation process for particles.

The search for a fabric-safe, easy-to-use laundry bleaching and detergent composition still exists.

Thus, there still remains a long felt need in this art for a cleaning and bleaching composition which does not adversely affect sensitive dyes, approaches the bleaching effect of sodium hypochlorite and, preferably, is available in powder form.

SUMMARY OF THE INVENTION

It is an object of the present invention to provide a stable bleaching and cleaning composition which removes stains through the use of a halogenated glycoluril compound which is coated with a polymer which is able to hydrate and dissolve at a pH greater than 6.0, preferably between 7.2 to 11.0. Pharmaceutically acceptable enteric coatings are particularly useful in the practice of the present invention.

More particularly, it is an object of the present invention to delay the dissolution of a halogenated glycoluril compound in alkaline wash water using a polymer coating which is able to hydrate and dissolve as a pH greater than 6.0, preferably between 7.2 and 11.0, until the halogenated glycoluril compound is essentially fully dispersed in the alkaline wash water. Good effects are also achieved in cold water.

It is another object of the present invention to provide a fabric-safe powder laundry detergent composition which provides controlled release of an oxidizing, halogenated glycoluril compound in an alkaline medium using a polymer coating which is able to hydrate and dissolve at a pH greater than 6.0, preferably between 7.2 and 11.0, for safe stain removal.

It has been found that stain removal and cleaning can be obtained using a powder composition containing a polymer coated halogenated glycoluril compound when the composition is dissolved in an aqueous composition at an alkaline pH.

It is an object of the present invention to provide a bleaching and cleaning detergent composition which removes stains from fabrics while not adversely causing the color of the fabric to fade or causing the fibers in the fabric to degrade by using a polymer coating which is able to hydrate and dissolve at a pH greater than 6.0, preferably between 7.2 and 11.0.

It is another object of the present invention to disclose a bleaching and cleaning composition which provides better bleaching and cleaning properties while still providing safe stain removal, i.e., avoiding pinholing, than any other composition known in the art by using a polymer coating which is able to hydrate and dissolve at a pH greater than 6.0, preferably between 7.2 and 11.0.

According to another aspect of the invention, there is provided a fabric-safe laundry detergent composition comprising a bleach stable surfactant, sometimes referred to as a detergent active material, and a halogenated glycoluril compound having the formula

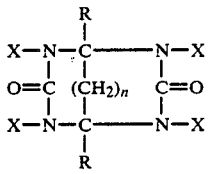

wherein each R is independently selected from hydrogen, $C_1$–$C_{10}$ straight or branched chain alkyl, aryl or alkyl substituted aryl; each X is independently selected from hydrogen, fluorine, chlorine, bromine and iodine and at least one X is not hydrogen and n is 0 or 1. The halogenated glycoluril compound has a polymer coating which is able to hydrate and dissolve at a pH greater than 6.0, preferably between 7.2 and 11.0. Optionally, builders to soften or tie up hard water minerals and to emulsify and/or peptize soil may be present.

According to still another aspect of the present invention, there is provided a fabric-safe laundry detergent composition which provides a substantially uniform controlled release of a halogenated glycoluril compound. The controlled release is provided by encapsulating the halogenated glycoluril compound in a polymer coating which is able to hydrate and dissolve at a pH greater than 6.0, preferably between 7.2 and 11.0 and thereby prevent release of the halogenated glycoluril compound on the surface of the fabric, but allows release of the halogenated glycoluril compound in alkaline wash water.

Thus, the present invention provides an improved detergent composition for general purpose bleaching and cleaning as well as for the safe bleaching and cleaning of fabrics.

DESCRIPTION OF THE PREFERRED EMBODIMENTS

Figure 1:
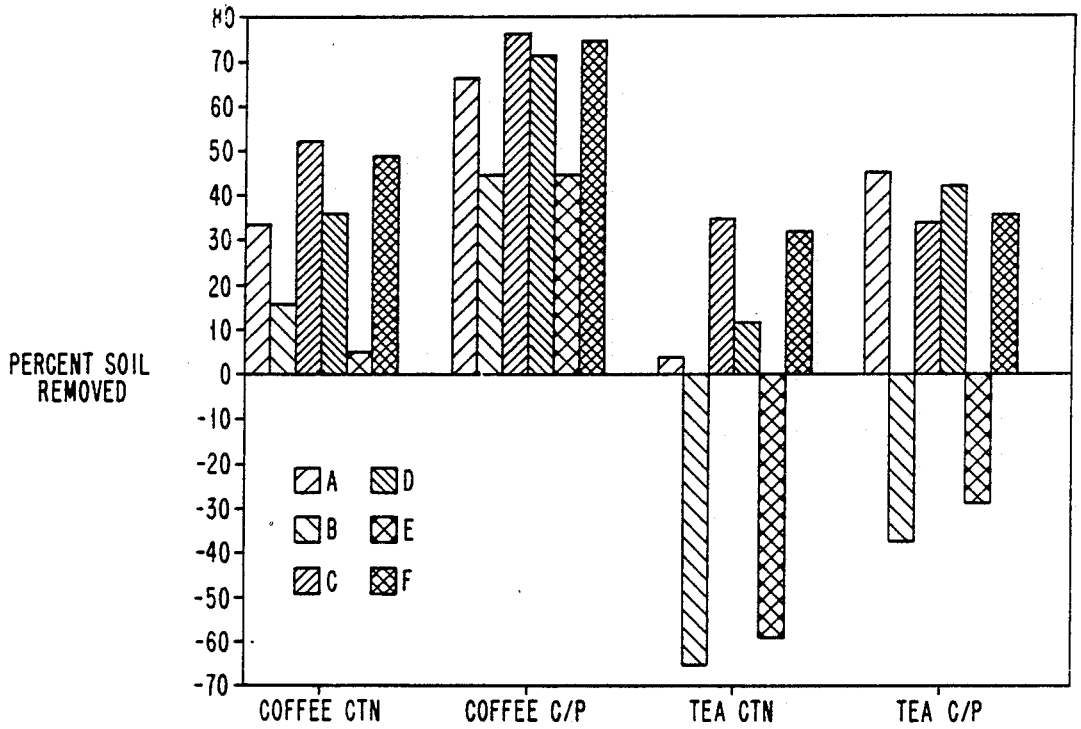
FIG. 1 is a bar graph of the percent soil removed for coffee or tea on cotton or cotton/polyester.

The halogenated glycoluril compound of the present invention has the formula

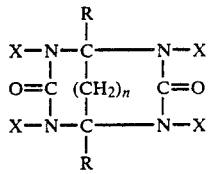

wherein each R is independently selected from hydrogen, $C_1$–$C_{10}$ straight or branched chain alkyl, aryl or alkyl substituted aryl; each X is independently selected from hydrogen, fluorine, chlorine, bromine and iodine and at least one X is not hydrogen, and n is 0 or 1. R is preferably hydrogen and n is preferably 0. The alkyl is preferably methyl, ethyl or propyl. The aryl group may be phenyl, naphthyl, benzyl and the like. The aryl group may be substituted with a $C_1$–$C_{10}$ straight or branched chain alkyl group. Generally, the greater the number of halogen atoms on the glycoluril structure, the better the bleaching and cleaning effect obtained. The preferred halogen is chlorine. The most preferred compound is 1,3,4,6-tetrachloroglycoluril which is also referred to as TCGU.

The halogenated glycoluril compounds of the present invention differ significantly from conventional chlorinating and bleaching agents in that by themselves they do not cause color damage on even the most sensitive of color dyes. Yet, when almost entirely dispersed in wash water in the presence of conventional alkaline laundry detergents, they are as fast acting and effective bleaching agents as sodium hypochlorite.

The term "coating" for purposes of the present invention is considered to include any coating means including microencapsulation techniques. Microencapsulation is a means of applying relatively thin coatings to small particles of solids or droplets of liquids in dispersions. In some reference texts microencapsulation has been arbitrarily differentiated from macrocoating techniques in that microencapsulation involves the coating of particles ranging dimensionally from several tenths of a micron to 5000 microns in size.

Advantageously, a variety of polymer coating materials have now been found to be particularly useful in the coating of halogenated glycoluril compounds for wash water. The coating materials prevent the halogenated glycoluril particles from being dissolved until they are essentially fully dispersed in the alkaline wash water. This delay is particularly advantageous because it prevents the occurrence of "pinholing" in the fabric being washed.

A major problem with the use of bleach or bleach-containing laundry detergent compositions is fabric damage from the localization of released bleach. Generally, bleaching products are placed into an automatic washing machine simultaneous with the dry load of laundry. Bleach and fabric thus remain in close contact as the washing machine fills with water. Local high concentrations of active bleaching ingredients thereby come into contact with fabric surfaces. Under these conditions, very small spots resembling pinholes appear on the fabric.

Unlike other possible coating materials, the coating material of the present invention allows for relatively rapid release of the halogenated glycoluril compound in cold wash water.

It is preferable that the formulated powder compositions of the present invention should be substantially free of moisture so as to prevent any reaction between the halogenated glycoluril compound and any other component in the detergent composition in order to assure a fabric-safe laundry detergent. Any water present is preferably in the form of a hydrate and not as free moisture. The polymeric coating is thus highly advantageous in providing a long shelf-life. Thus, the presence of free moisture in the detergent powder would not be as critical for a polymer coating designed to hydrate and dissolve at a pH greater than 6.0 as it might otherwise be for other types of coatings.

The halogenated glycoluril compositions are typically dissolved in the wash liquid at a concentration from about 0.5 g/l to about 5 g/l, preferably about 2 g/l. This amount may vary depending on a variety of factors such as the presence of other additives in the composition, type of laundry being washed and the like.

The polymer coating materials are designed such that they release the halogenated glycoluril compound of the present invention within about 30 seconds to five minutes, preferably within about one to three minutes, following dispersion of the coated material in the wash water.

The release times of the polymer coating materials may be controlled in a variety of ways. One such way is to control the thickness of the polymer coating material on the halogenated glycoluril particles. Obviously, other factors such as the degree of polymerization would also be a factor.

The typical pH of wash water is generally within the range of about 9.0 to 11.5, more generally 9.5 to 11.0. Thus, such a range would be the most preferred pH range for a detergent solution in which the solubilization and bleaching action of the halogenated glycoluril compounds are most favored.

The polymer coating material of the present invention is able to hydrate and dissolve at a pH of greater than 6.0 and preferably 7.2 to 11.0. More preferably, the polymer is able to hydrate and dissolve at a pH within the range of 9.0 to 11.0. Such pH's would allow relatively rapid dissolution of the polymeric coating in the alkaline wash environment and thereby allow release of the halogenated glycoluril compound.

A class of materials which are particularly useful polymer coating materials in the practice of the present invention are pharmaceutical enteric coating materials. Enteric coated tablets were developed in the art of pharmaceutical sciences as a method of controlling the site of drug release. An enteric coating is typically defined as a film which does not permit release of a significant quantity of drug in the stomach but rapidly releases the drug when the dosage form passes into the intestine. The solid drug-containing particles may be in a variety of sizes ranging from fine powders to approximately onehalf inch diameter tablets.

The coatings that are used today to produce enteric effects are primarily mixed acid functionality and acid ester functionality synthetic or modified natural polymers. Cellulose acetate phthalate has the longest history of use as an enteric coating. More recently, polyvinyl acetate phthalate and hydroxypropyl methylcellulose phthalate have come into use. All three polymers have the common feature of containing the dicarboxylic acid, phthalic acid, in partially esterified form. These polymers, being acid esters, are insoluble in gastric media that have a pH of up to about 4; they are intended to hydrate and dissolve as the tablet leaves the stomach, enter the duodenum (pH of 4 to 6), and move further along the small intestine, where the pH increases to a range of 7 to 8. The primary mechanism by which these polymers lose their film integrity is ionization of the residual carboxyl groups on the chain and subsequent hydration.

Enteric coating materials include hydroxypropyl methylcellulose phthalate, polyvinyl acetate phthalate (PVAP), acrylate polymers and cellulose acetate phthalate (CAP). Hydroxypropyl methylcellulose is generally preferred because it is chemically stable and forms strong films.

There are three enteric polymers commercially available from Shin-Etsu Chemical Company. These polymers are derived from hydroxypropyl methylcellulose, N.F., by esterification with phthalic anhydride, and are marketed as HPMCP 50, 55 and 55S. HPMCP is the trade name for hydroxypropyl methylcellulose phthalate. These polymers dissolve at a lower pH (at 5 to 5.5) than CAP or acrylic copolymers. These polymers are quite stable compared with CAP because of the absence of labile acetyl groups.

Polyvinyl acetate phthalate (PVAP) is manufactured by the esterification of a partially hydrolyzed polyvinyl acetate with phthalic anhydride. This polymer is similar to HP-55 in stability and pH-dependent solubility. It is supplied as read-to-use or ready-to-disperse enteric systems.

A series of acrylate polymers is marketed under the trademark Eudragit. Eudragit E is a cationic copolymer based on dimethylaminoethyl methacrylate and other neutral methacrylic acid esters, and is the only Eudragit material that is freely soluble in gastric fluid up to pH 5, and is expandable and permeable above at least pH 5. This material is available as an organic solution (12.5%) in isopropanol/acetone, a solid material, or a 30% aqueous dispersion. Eudragit RL and RS are copolymers synthesized from acrylic and methacrylic acid esters with a low content of quaternary ammonium groups. They are available only as organic solutions and solid materials. These polymers produce films for the delayed-action (pH-independent) preparations.

Two forms of commercially available enteric acrylic resins are also Eudragit L and Eudragit S. Eudragit L and S are soluble at pH 6 and 7, respectively. Eudragit L is available as an organic solution (e.g., isopropanol), solid, or aqueous dispersion. Eudragit S is available only as an organic solution (e.g., isopropanol) and a solid.

Cellulose acetate phthalate (CAP) has been widely used in the industry. For the purposes of this invention, it has the advantage of dissolving only above pH 6. CAP films are brittle and usually formulated with hydrophobic-film forming materials or adjuvants to achieve a better enteric film. FMC Corporation has developed an aqueous enteric coating called Aquateric. Aquateric coating is a reconstituted colloidal dispersion of latex particles (not a solvent solution coating system). It is composed of solid or semi-solid polymer spheres of cellulose acetate phthalate ranging in size from 0.05 to 3 microns with an average particle size of 0.2 micron.

The coating process may be conducted by any procedure known in the art of coating powders and other particles. Such coating or microencapsulation processes typically include air suspension coating, spray drying, spray congealing, coacervation phase separation, multi-orifice centrifugal processing, pan coating, solvent evaporation, vacuum deposition, polymerization, air suspension and the like. A description of such processes may be found in standard reference textbooks such as "Remington's Pharmaceutical Sciences" and Lachman et al, "The Theory and Practice of Industrial Pharmacy" (1986), pp. 419–428.

The halogenated glycoluril may be in a powder form, a granular form, a solubilized or suspended liquid form or in any other form which would lend itself to coating.

One possible method of coating the halogenated glycoluril of the present invention is the use of coating pans. A variety of shapes, sizes and designs of coating pans are available in the art. Coating pans are generally motor driven, sometimes with variable speed drives and the pan is usually tilted at some angle from horizontal. Some pans are designed so that drying air may be introduced through perforations in the side or through the connecting hub in the rear of the pan. Baffles or flights may be placed in the pan.

Reasons for differences in design of the coating pan become apparent when the coating pan is considered as a mixing device. Efficient mixing is important if a uniformly coated product is desired.

Other types of coating apparatus include fluid-bed coaters, spouted-bed coaters, coacervation tanks and presscoating machines.

The principle of a fluid bed coater is to pass air through a bed of particles at a velocity sufficient to support and separate the particles as more or less individual units. The particles are sprayed with the coating material at some point in the cycle. The particles move in a cyclical fashion within the fluidized coater. The cyclical action can be augmented by increasing the air velocity in the center of the bed. That method is called spouting and thus those devices are referred to as spouted-bed coaters.

In the coacervation process, the halogenated glycoluril particles are suspended in a liquid in which they are insoluble. The coating agent is added to the liquid and coated by coacervation induced by adding a third agent or by changing conditions, for example, heating or cooling, in the suspension. A coacervate film is formed at the particle-liquid interface and may be hardened by the addition of a suitable agent. The coated halogenated glycoluril may then be separated from the liquid and dried.

Air suspension involves dispersing solid, particulate halogenated glycoluril compounds in a supporting air stream followed by spray coating the air suspended particles.

Coacervation phase separation involves formation of three immiscible chemical phases, deposition of the coating and rigidization of the coating. Each of the three steps is carried out under agitation.

Multiorifice centrifugation involves using centrifugal forces to hurl a core material particle, such as halogenated glycoluril, through an enveloping encapsulation membrane thereby effecting mechanical encapsulation.

Spray drying and spray congealing processes are similar in that both involve dispersing the core material in a liquified coating substance and spraying or introducing the core coating mixture into some environmental condition whereby relatively rapid solidification and formation of the coating is effected. The principal difference between spray drying and spray congealing is the means by which the coating solidification is accomplished.

Coating solidification in the case of spray drying is effected by rapid evaporation of a solvent in which the coating material is dissolved. Coating solidification in spray congealing methods, however, is accomplished by thermally congealing a molten coating material or by solidifying a dissolved coating by introducing the coating-core material mixture into a nonsolvent. Removal of the nonsolvent or solvent from the coated product is then accomplished by sorption, extraction or evaporation techniques.

In the solvent evaporation technique, the process is carried out in a liquid manufacturing vehicle. The microcapsule coating is dissolved in a volatile solvent, which is immiscible with the liquid manufacturing vehicle phase. A core material to be microencapsulated is dissolved or dispersed in the coating polymer solution. With agitation, the core coating material mixture is dispersed in the liquid manufacturing vehicle phase to obtain the appropriate size microcapsule. The mixture is then heated, if necessary, to evaporate the solvent from the polymer. In the case in which the core material is dispersed in the polymer solution, the polymer shrinks around the core. In the case in which the core material is dissolved in the coating polymer solution, a matrix-type microcapsule is formed. Once all the solvent for the polymer is evaporated, the liquid vehicle temperature is reduced if necessary to ambient temperature with continued agitation. At this stage, the microcapsules can be used in suspension form, coated onto substrates or isolated as powders.

The polymerization reaction method involves the reaction of monomeric units located at the interface existing between a core material substance and a continuous phase in which the core material is dispersed. The continuous or core material supporting phase is usually a liquid or gas, and therefore the polymerization reaction occurs at a liquid-liquid, liquid-gas, solid-liquid or solid-gas interface.

The coating material itself may be introduced into the coating apparatus by any procedure known in the art. The coating material can be poured or "ladled" onto the rotating mass in the coating apparatus. Alternatively, the coating material may be sprayed using atomizers which break up the liquid into rather fine droplets. Devices used for that purpose include pneumatic nozzles, wheel atomizers and pressure nozzles.

The polymer coated halogenated glycoluril compound of the present invention may be used alone or it may be available prepackaged in combination with a detergent. The formulation may be in the form of a powder, granule or liquid. However, based on the solubility of the halogenated glycoluril compounds and the ease-of-use of the powder, the powder detergent composition is preferred.

In formulating compositions for use as a fabric-safe powder laundry detergent composition, a variety of ingredients may be included to provide the necessary detergency and other properties desirable in a laundry detergent. The halogenated glycoluril compound generally comprises about 5 to 15% weight, preferably about 9 to 11% weight of the entire detergent composition. The precise amount may vary depending on the use detergent and other additives selected. Thus, the amount of halogenated glycoluril compound useful in the practice of the present invention is a sufficient amount to achieve a bleaching effect.

The detergent active material is known to those skilled in this art and may be characterized as a bleach stable surfactant and may be a naturally derived material, such as soap, or a synthetic detergent active material selected from anionic, nonionic, cationic, zwitterionic, amphoteric materials or mixtures thereof. Preferred surfactants are of either the anionic or nonionic type. Normally, laundry detergent compositions will contain from about 5 to 20% by weight surfactant based on the safe detergent composition depending on the type of surfactant selected and whether high foaming or low foaming properties are desired. While not wishing to be bound by any theory, it is believed that the detergent/surfactant forms micelles around the halogenated glycoluril compound.

Fabric-safe laundry detergent compositions of the present invention would preferably also contain detergency builders. Suitable builders typically include alkali metal tripolyphosphate, such as sodium tripolyphosphate; sodium orthophosphate; alkali metal carbonates; sodium citrate; carboxymethylmalonate and a water insoluble crystalline or amorphous aluminosilicate, or mixtures thereof. The preferred builder material is sodium tripolyphosphate which serves to both soften hard-water minerals and to emulsify soil. Detergency builders employed in the fabric-safe laundry detergent compositions of the present invention are generally in the range of 15–50% by weight, preferably from about 25–50% by weight of the entire detergent composition. However, higher amounts are possible depending on the concentration derived from the selected end use.

The prior art's failure to successfully appreciate the novel bleaching and cleaning properties of the present invention, in part, was due to the failure to recognize or develop a method for overcoming what is described as the limited solubility of halogenated glycoluril compounds in water. Applicant has discovered that a polymer coating able to hydrate and dissolve at a certain pH is important for achieving the effective bleaching properties of the halogenated glycoluril compounds of the present invention. In particular, the present inventor has discovered that alkaline conditions typically found in detergent wash water favorably affect the bleaching ability of the halogenated glycoluril compounds. Upon hydration and dissolution of the polymeric coating surrounding the halogenated glycoluril compound in water, the halogenated glycoluril compound would then be exposed to a pH of approximately 9.0 to 11.5, preferably 9.5 to 11.O for maximum cleaning and oxidizing effects. The pH in the alkaline range is due to the presence of the alkaline detergent/surfactant materials in the detergent composition.

Therefore, in formulating the compositions of the invention, it is essential that components be added to ensure that the desired pH is achieved and maintained when the composition is dissolved in water. Ingredients suitable for enhancing and maintaining the alkalinity of the detergent composition are well-known in this art and include alkali metal phosphates, alkali metal silicates, alkali metal carbonates, and the like. Sodium silicate, for instance, is typically present in laundry detergent compositions in an amount ranging from about 5% to 15%.

Thus, in formulating fabric-safe laundry detergent compositions according to the present invention, the delayed or controlled release of the halogenated glycoluril compound before contact with the fabric to be washed in water has the advantage of ensuring that localized high concentration of halogenated glycoluril compound will be avoided, thereby avoiding fading color fabrics or damage to the fabric fibers. In addition, in compositions formulated with enzymes, immediate release of a chlorinating compound could destroy the enzymes before their use, thereby affecting the efficacy of the laundry detergent. By delaying the release of the halogenated glycoluril compound, the enzymes would have sufficient time to perform their intended function.

The fabric-safe laundry detergent composition of the present invention may contain one or more ingredients other than those identified above which are well known to those of ordinary skill in this art, for example, optical brightening agents, antiredeposition agents such as carboxymethylcellulose, enzymes, perfume, processing aids and the like. Such additional ingredients are well-known to those of ordinary skill in this art.

While the invention has been particularly described in connection with its application to fabric-safe powder laundry detergent compositions, it will be readily understood by one of ordinary skill in the art that the benefits which ar obtained by the use of a halogenated glycoluril compound will apply equally well to other bleaching and cleaning compositions for general purpose cleaning and automatic dishwashing detergents.

While the present invention is described above in connection with preferred or illustrative embodiments, these embodiments are not intended to be exhaustive or limiting of the invention. Rather, the invention is intended to cover all alternatives, modifications and equivalents included within its spirit and scope, as defined by the appended claims.

The present invention is further illustrated by the following examples wherein all parts and percentages are by weight unless stated otherwise.

EXAMPLE 1

Effect of pH on Dye Color

Red dye swatches were wet with a series of solutions of various pH and solid 1,3,4,6-tetrachloroglycoluril was placed on the wet swatches. The swatches were observed for at least five minutes for dye damage. The solutions used and observations made are set forth in Table I.

TABLE I

| SAMPLE | | |
|---|---|---|
| 1 | tap water, pH unknown | no change observed |
| 2 | monosodium phosphate, pH 4.5 | no change |
| 3 | sodium bicarbonate, pH 8.3 | some slight discoloration noted |
| 4 | sodium tripolyphosphate, pH 9.8 | discoloration evident |
| 5 | soda ash, pH 11.6 | damage present |
| 6 | Monsanto ACL-90+ trichloro-s-triazinetrione | definite bleaching observed within minutes |
| 7 | sodium metasilicate pH > 11 | observed effervescence, swatch turned purple, white spots appeared within minutes |

Sample 6 was a control to test the effect of Monsanto ACL-90+bleaching compound for comparison purposes on the wet Example 1 shows that the activation of 1,3,4,6-tetrachloroglycoluril is pH dependent; that is, the higher the pH, the greater the damage to the red dye swatches. Thus, 3,4,6-tetrachloroglycoluril should preferably be well dispersed prior to dissolution in wash water.

EXAMPLE 2

Effect of Buffer Solution on Dye

The purpose of this example was to demonstrate the effect of various buffers to determine any possible dye damage on the test swatches. The same test procedure was followed as described in Example 1.

TABLE II

| SAMPLE | | |
|---|---|---|
| 8 | monosodium phosphate | no change observed |
| 9 | sodium bicarbonate | no change observed |
| 10 | sodium tripolyphosphate | no change observed |
| 11 | soda ash | no change observed |
| 12 | sodium metasilicic | no change observed |
| 13 | non-phosphate laundry detergent (Sun Glory TM) | no change observed |

Sun Glory is distributed by Stop and Shop Co. in Boston, Mass. It is a high-foaming, spray-dried, non-phosphate detergent composed of an anionic surfactant (sodium dodecylbenzenesulfonate), sodium carbonate, sodium sulfate, sodium chloride, sodium silicate, fabric whitener and fragrance.

Example 2 shows that 1,3,4,6-tetrachloroglycoluril is likely the cause of the dye damage which resulted in Example 1 since no dye damage was apparent with the use of buffer alone on the wet swatches in Example 2.

EXAMpLE 3

Effects of Monosodium Phosphate in Inhibitinq Dye Damage

For samples 14A and 14B, 1,3,4,6-tetrachloroglycoluril was placed on a damaged red dye swatch and was covered with monosodium phosphate. Sun Glory detergent was then applied to the swatches. For samples 15A and 15B, the monosodium phosphate was omitted. Damage was evident in samples 15A and 15B but not in samples 14A or 14B. Next, 5 gm of detergent was blended with 0.25 gm 1,3,4,6-tetrachloroglycoluril. One-half of each swatch corresponding to samples 16A and 16B was covered with the blend, the other half of each swatch were covered with detergent alone. The damage to the swatch was observed with the blend.

The blend of 1,3,4,6-tetrachloroglycoluril plus detergent was diluted by a factor of 10 and the above test was repeated as samples 17A and 17B. No dye damage was observed.

Example 3 demonstrates that a blend of 1,3,4,6-tetrachloroglycoluril and detergent causes red dye swatch damage at a concentration of 0.25% 1,3,4,6-tetrachloroglycoluril and 5% detergent, whereas, a 0.5% detergent blend does not.

EXAMPLE 4

Bleaching Capacities of 1,3,4,6-Tetrachloroglycoluril

Four solutions were prepared to test their ability to bleach out standard grape juice stains. To 100 ml of tap water, 0.2 gm of detergent was added. The test samples are identified in Table III.

TABLE III

| | |
|---|---|
| 18 | a detergent control |
| 19 | add 0.4 gm Clorox TM bleach |
| 20 | add 0.012 gm 1,3,4,6-tetrachloroglycoluril |
| 21 | add 0.002 gm 1,3,4,6-tetrachloroglycoluril |

Grape juice stain swatches were added to the flasks and swirled regularly and almost continuously. The swatches and solutions were observed at 1, 2, 3, 5, 10 and 20 minutes.

TABLE IV

| | Sample | | | |
|---|---|---|---|---|
| Minutes | 18 | 19 | 20 | 21 |
| 1 | darker purple | pink | purple | purple |
| 2 | purple | pink | light purple | purple |
| 3 | purple | light pink | light purple | purple |
| 5 | light purple | light pink | light pink | light purple |
| 10 | light purple | very light pink | very light pink | light purple |
| 20 | light purple | almost white | very light pink | very light purple |

The 20-minute observations were made on swatches that had been rinsed off. All solutions were water clear except for the detergent alone (sample 18) which had a pink hue.

Example 4 demonstrated that 1,3,4,6-tetrachloroglycoluril has very good stain removing capacity against grape juice with the potential for low damage to colors and fabrics if it is isolated from high pH until diluted in wash water. Thus, by delaying the release of the halogenated glycoluril compound into the wash water by using a polymer coating, dye damage, i.e., pinholing would not result.

EXAMPLE 5

Bleaching Capacity of 1,3,4,6-Tetrachloroglycoluril

Five solutions were prepared for testing of their ability to bleach out standard coffee stains. To 100 ml of tap water, 0.2 gm of detergent was added. Example 5 was conducted similar to Example 4. Table V identifies the composition of each test sample. The results are set forth in Table VI.

TABLE V

| Sample | |
|---|---|
| 22 | detergent control |
| 23 | add 0.4 gm Clorox bleach |
| 24 | add 0.01 gm 1,3,4,6-tetrachloroglycoluril |
| 25 | add 0.002 gm 1,3,4,6-tetrachloroglycoluril |
| 26 | add 0.02 gm sodium perborate |

A test red dye damage swatch (sample 27) was also dampened with tap water and solid sodium perborate was placed on it. Detergent was added to one half of the swatch. There was no damage observed after 10 minutes on either the half with perborate alone or the half with the perborate plus detergent.

As evidenced from Example 5, 1,3,4,6tetrachloroglycoluril has very good stain removing capacity against coffee, with the potential for low damage to colors and fabrics if it is kept isolated from high pH until it has the opportunity to be diluted in the wash water.

TABLE VI

| Minutes | Sample 22 | 23 | 24 | 25 | 26 |
|---|---|---|---|---|---|
| 2 | Swatch darkened solution yellow | Lightening solution clear | Lightening solution clear | Some lightening solution clear | Swatch darker solution yellow |
| 5 | still dark | lightest | light | not as light | dark but lighter than 22 |
| 10 | worst solution yellow | lightest | almost as light as 23 | not as light as 24 | second worst still dark tan |
| 20 | still dark tan | lightest | next | almost as light as 24 | still dark tan |

EXAMPLE 6

Comparative Stain Removal Test

A series of solutions identified in Table VII were tested for their ability to remove grape juice stain. 0.2 gm of 1,3,4,6-tetrachloroglycoluril was added to 100 ml tap water and Sun Glory detergent as noted in sample 29.

TABLE VII

| Sample | |
|---|---|
| 28 | detergent control |
| 29 | add 0.2 gm 1,3,4,6-tetrachloroglycoluril |
| 30 | add 0.002 gm 1,3,4,6-tetrachloroglycoluril |
| 31 | add 0.025 gm sodium perborate |

TABLE VIII

| Minutes | Sample 28 | 29 | 30 | 31 |
|---|---|---|---|---|
| 1 | purple | purple | purple | purple |
| 2 | purple | purple | purple | purple |
| 5 | poorest | best | poor | poorest |
| 10 | no bleaching | best | 2nd best | no bleaching |
| 15 | — | white | — | — |
| 20 | worst | white | white w/ hint of pink | 3rd worst |

Example 6 demonstrates that 1,3,4,6-tetrachloroglycoluril plus detergent was very effective in the removal of grape juice stains. Detergent alone provided little or no stain removal benefit. Sodium perborate plus detergent did not appear to be much better.

EXAMPLE 7

Dye Damage on Blue Swatches

A series of solutions identified in Table IX were tested for their ability to remove grape juice stain. The same procedure was followed as described in the earlier examples.

TABLE IX

| Sample | |
|---|---|
| 32, 35 | 0.95 gm Sun Glory + 0.5 gm 1,3,4,6-tetrachloroglycoluril |
| 33 | 0.95 gm Sun Glory + 0.025 gm 1,3,4,6-tetrachloroglycoluril |
| 34, 36 | 0.99 gm Sun Glory + 0.10 gm 1,3,4,6-tetrachloroglycoluril |

Samples 32, 33 and 34 were placed on one-half of the blue swatch and detergent alone was placed on the other half. Samples 35 and 36 were conducted as above, but were applied to red swatches.

After 5 minutes, samples 32, 33 and 34 all showed a very slight degree of dye lightening on the side with 1,3,4,6tetrachloroglycoluril and no apparent damage on the detergent control side. On the red swatch, damage was evident on the 1,3,4,6-tetrachloroglycoluril containing side of sample 35, but no damage was observed on sample 36. Blue bleach sensitive dye swatches were found to be even more sensitive to color damage than the red swatches.

The following samples were also tested:

TABLE X

| Sample | |
|---|---|
| 37 | This was a repeat of 34. The same result was observed. |
| 38 | Calcium hypochlorite was placed onto a blue swatch and covered with detergent. Very active bleaching was observed in less than one minute. |
| 39 | 1,3,4,6-Tetrachloroglycoluril was placed on a blue swatch and covered with detergent. Mild discoloration was observed in about one minute. |
| 40 | 1,3,4,6-Tetrachloroglycoluril alone was placed on a blue swatch. No color damage was observed. |

Example 7 shows that some red swatches were more sensitive than other swatches. The blue swatches were even more sensitive. Some of the compositions did not damage the red swatches even though they had damaged the blue swatches. Thus, only on ultrasensitive fabrics are you likely to require protection of the halogenated glycoluril compound from the fabric.

Example 7 shows that 1,3,4,6-tetrachloroglycoluril is unique among chlorinating/bleach agents in that it does not have the capacity to cause color damage by itself, yet when used in the presence of a detergent it provides a bleaching capacity which is almost as effective a liquid Clorox.

EXAMPLE 8

Comparison of Detergent and Bleaching Effect

This example compared the bleaching performance between a non-phosphate detergent with and without 1,3,4,6-tetrachloroglycoluril versus phosphate Tide TM with Bleach, the current industry standard.

The non-phosphate detergent is a high-foaming, high quality, spray-dried laundry detergent composed of 19% sodium dodecylphenylsulfonate, 25% soda ash, 8% sodium silicate, antisoil redeposition agent, fluorescent brighteners and processing aids. No perfume is present. It is similar to Sun Glory but has a different proportion of ingredients.

A terg-o-tometer test was conducted. The test conditions are set forth below:

Water Temp.: 80° F.

Water hardness: 150 PPM

Fabric employed: Cotton (CTN) Cotton & Polyester (C/P)

Soil: EMPA 103 (type of soil swatches) Coffee and Tea

The wash load involved six 6-inch X 4-inch soiled swatches in one liter of wash water. The wash cycle lasted ten minutes, and the rinse cycle involved two 5 minute rinses.

The color of the swatches were read before and after the wash and rinse using a Hunter Lab Reflectometer. The color difference is presented as a percentage of soil removed in Table XI. FIG. 1 is a bar chart that shows the color percentage difference.

the products tested included:

| | Products | Total grams/potassium grams |
|---|---|---|
| (A) | Tide with Bleach* | 2 Grams |
| (B) | NO PHOS. Detergent | 2 Grams |
| (C) | NO PHOS. Detergent + 1,3,4,6-tetrachloroglycoluril | 2 gr. + 0.2 gr. |
| (D) | Tide with Bleach | 2 Grams |
| (E) | NO PHOS. Detergent | 2 Grams |
| (F) | NO PHOS. Detergent + 1,3,4,6-tetrachloroglycoluril | 2 gr. + 0.2 gr. |

*Tide is a registered trademark for a detergent manufactured by the Proctor & Gamble Company.

TABLE XI

| | Percent of Soil Removed | | | |
|---|---|---|---|---|
| | Coffee CTN | Coffee C/P | Tea CTN | Tea C/P |
| A | 33.1 | 66.7 | 3.6 | 44.6 |
| B | 14.7 | 44.8 | −64.8 | −37.5 |
| C | 51.9 | 76.2 | 33.8 | 33.3 |
| D | 35.9 | 71.4 | 11.1 | 41.6 |
| E | 4.5 | 45.0 | −58.6 | −28.0 |
| F | 48.7 | 74.5 | 31.0 | 35.0 |

Example 8 demonstrates that Tide with Bleach is better on tea on cotton/polyester.

The non-phosphate detergent and 1,3,4,6-tetrachloroglycoluril is better on coffee on cotton, coffee on cotton/polyester and tea on cotton.

EXAMPLE 9

Comparison of Detergent and Bleaching Effect

This example was conducted similar to Example 8 except that different soils, i.e., japanese ink, oil, blood and wine were removed.

Figure 2:
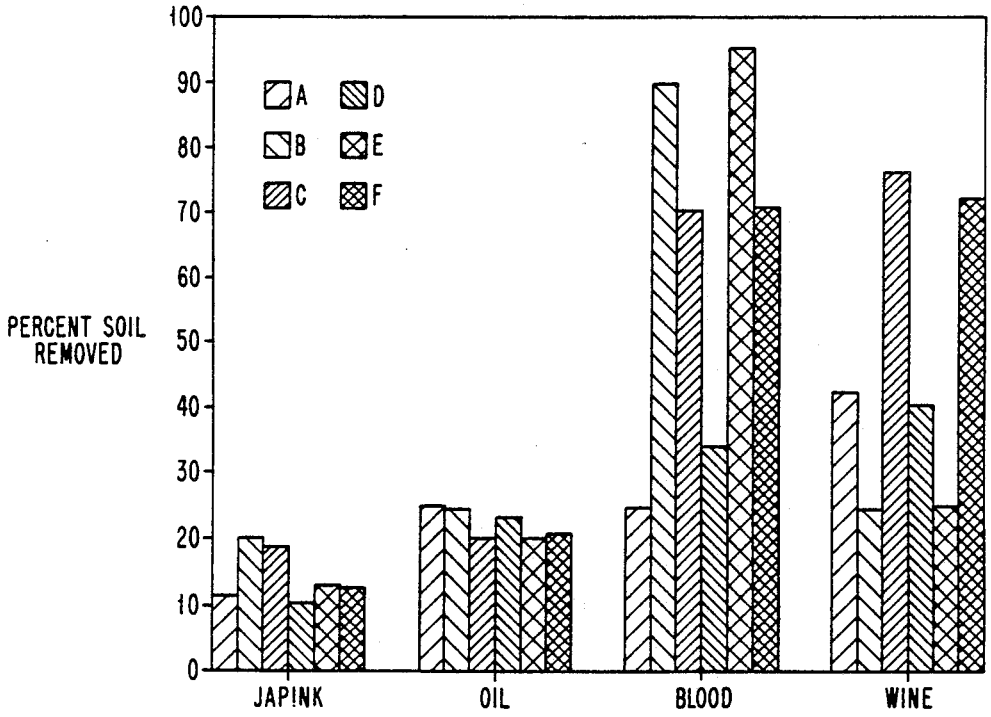
FIG. 2 is a bar graph of the percent soil removed for Japanese ink, oil, blood and wine on cotton.

Table XII shows the difference in soil removed as a percent. FIG. 2 is a bar graph depicting the percent of soil removed for the various soil types.

TABLE XII

| | Percent of Soil Removed | | | |
|---|---|---|---|---|
| | Jap. Ink | Oily | Blood | Wine |
| A | 11.2 | 24.5 | 24.5 | 42.2 |
| B | 19.9 | 23.9 | 90.2 | 24.5 |
| C | 18.0 | 19.9 | 71.1 | 76.8 |
| D | 9.9 | 22.9 | 33.5 | 40.1 |
| E | 12.6 | 20.0 | 95.2 | 25.0 |
| F | 12.2 | 20.6 | 71.6 | 72.9 |

EXAMPLE 10

Comparison of Detergent and Bleaching Effect

This example compared the bleaching performance between the non-phosphate detergent describe in Example 8 along with and without 1,3,4,6-tetrachloroglycoluril and non-phosphate Tide with bleach. Thus, all detergent compositions disclosed in this example are non-phosphate.

A terg-o-tometer test was conducted. The wash load and test conditions were as set forth in Example 8.

TABLE XIII

| | PERCENT OF SOIL REMOVED | | | | | |
|---|---|---|---|---|---|---|
| | Coffee CT | Coffee | Tea CTN | Tea C/P | Grass CTN | Grass C/P |
| A | 49.4 | 73.7 | −12.5 | 22.5 | 78.7 | 61.8 |
| B | 25.8 | 60.0 | −56.7 | −25.0 | 48.6 | 26.4 |
| C | 60.6 | 50.0 | 32.1 | 30.3 | 70.9 | 44.8 |
| D | 53.1 | 74.7 | −14.1 | 16.7 | 75.8 | 59.3 |
| E | 25.0 | 56.7 | −62.1 | −21.4 | 51.4 | 34.5 |
| F | 58.1 | 45.9 | 36.0 | 36.0 | 70.2 | 41.7 |

Figure 3:
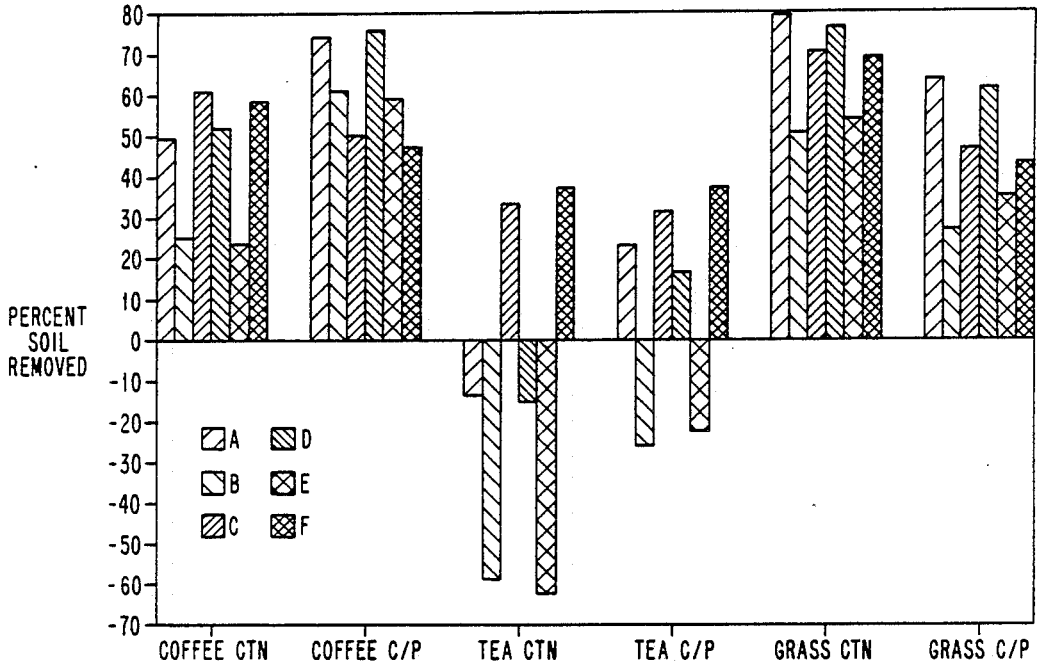
FIG. 3 is a bar graph of the percent soil removed for coffee, tea or grass on cotton or cotton/polyester.

Table XIII is depicted as a bar graph in FIG. 3 and demonstrates that overall, the detergent/halogenated glycoluril compound of the present invention provides the best bleaching/stain removal effect.

EXAMPLE 11

Comparison of Detergent and Bleaching Effect

This example was conducted similar to Example 10 except that different soils were removed. Once again, the detergent/halogenated glycoluril compound of the present invention provided an excellent bleaching stain removal effect.

Figure 4:
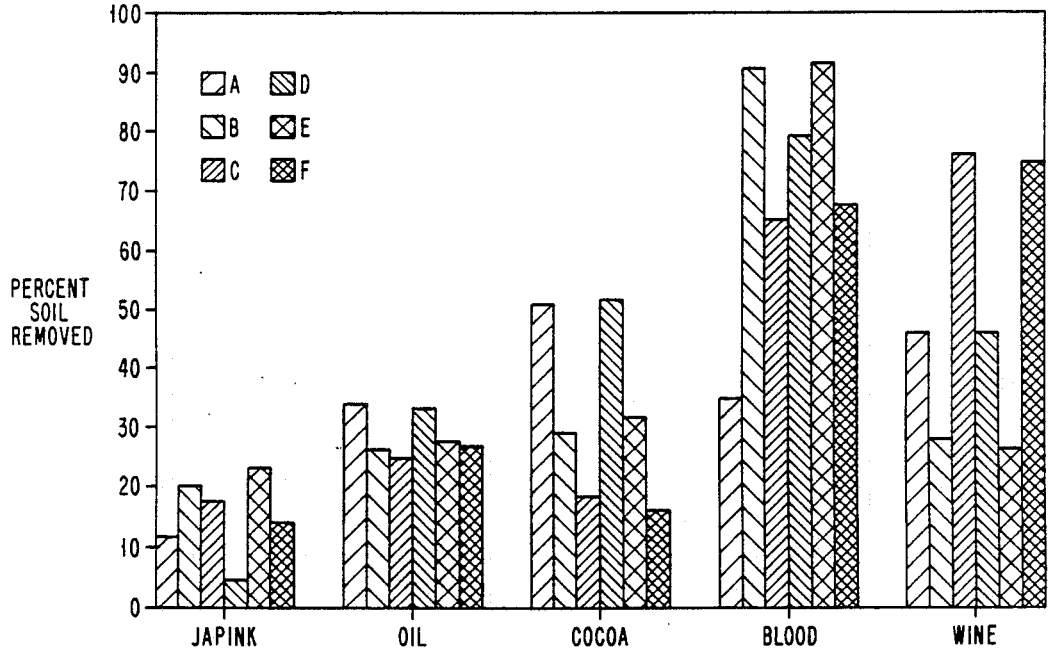
FIG. 4 is a bar graph of the percent soil removed for Japanese ink, oil, cocoa, blood and wine on cotton.

Table XIV shows the difference in soil removed as a percent. FIG. 4 is a bar graph depicting the percent of soil removed for the various soil types.

TABLE XIV

| | PERCENT OF SOIL REMOVED | | | | |
|---|---|---|---|---|---|
| | Jap. Ink | Oily | Cocoa | Blood | Wine |
| A | 11.5 | 31.7 | 47.5 | 33.1 | 43.3 |
| B | 19.0 | 24.4 | 27.3 | 91.6 | 26.9 |
| C | 16.4 | 23.4 | 17.2 | 68.2 | 78.4 |
| D | 4.2 | 31.1 | 48.1 | 81.8 | 43.3 |
| E | 21.3 | 26.1 | 29.6 | 92.4 | 25.1 |
| F | 13.9 | 25.1 | 15.4 | 70.3 | 76.9 |

EXAMPLE 12

Determination of pH to Dissolve Halogenated Glycoluril

The purpose of the present example was to determine the pH conditions required to dissolve approximately 1% 1,3,4,6-tetrachloroglycoluril in water in the presence of detergent.

First, 100 mg of 1,3,4,6-tetrachloroglycoluril was placed in 20 ml of phosphate buffers at pH 2, 7 and 12 in an attempt to determine which would dissolve. It was determined that 1,3,4,6-tetrachloroglycoluril was not visibly soluble at pH 2 and 7. At pH 12, however, all 100 mg of 1,3,4,6-tetrachloroglycoluril dissolved. Therefore, as the pH was increased, the solubility of the 1,3,4,6-tetrachloroglycoluril in water also increased.

The above experiment was repeated using phosphate buffers at pH 10, 10.5, 11, 11.5, 12, 12.5, 13 and 13.5. At pH 11 and above, all 100 mg of 1,3,4,6-tetrachloroglycoluril dissolved, but the solutions turned yellow and developed a disagreeable odor. It was concluded that 1,3,4,6tetrachloroglycoluril decomposed in aqueous solution at approximately pH 11 and above.

To determine the effect of a detergent on the solubility, the above experiment was repeated using phosphate buffers at pH 10 and 10.5 containing 1% sodium lauryl sulfate. At both pH's, all 100 mg of the 1,3,4,6-tetrachloroglycoluril dissolved. At pH 10.5, dissolution occurred rapidly, and the solution developed a disagreeable odor, although the odor was not as strong as observed previously at pH 11 and above. At pH 10.0, dissolution was complete in about one hour, and there was only a slight chlorine odor. It was concluded that pH 10.5 is the maximum for solubilization of 1,3,4,6-tetrachloroglycoluril, but pH 10.0 is better because it avoided decomposition.

In the final procedure, 1,3,4,6-tetrachloroglycoluril was solubilized in pH 10.0 phosphate buffer containing 1% sodium lauryl sulfate.

A 0.5 M, pH 10.0, phosphate buffer was prepared by dissolving approximately 30 gm $NaH_2PO_4$ in 500 ml distilled water and adjusting the pH to 10.0 by dropwise addition of saturated sodium hydroxide in water.

A 2% sodium lauryl sulfate solution was prepared by dissolving approximately 2 gm sodium lauryl sulfate USP in 100 ml distilled water.

200 mg of 1,3,4,6-tetrachloroglycoluril powder was weighed out and placed in a 100 ml volumetric flask. 20 ml of 0.5 M, pH 10.0, phosphate buffer as prepared above was added and 20 ml of 2% sodium lauryl sulfate solution as also described above was added. The flask was agitated by hand until all the powder was dispersed. The mixture was sonicated in a Bransom sonicator for about one minute with intermittent agitation. The flask was warmed under running hot tap water for about 2 minutes and the agitation continued. After about 2 hours, all the 1,3,4,6-tetrachloroglycoluril powder had dissolved. The resulting solution had a slight chlorine odor, but not the disagreeable odor associated with phosphate buffer solutions above pH 11.0.

The alkalinity of the phosphate buffer at a pH of about 10.0 combined with the micellar solubilization produced by a detergent, such as sodium lauryl sulfate, produces an aqueous solution containing 0.5% 1,3,4,6-tetrachloroglycoluril.

While the invention has now been described with reference to several preferred embodiments, those skilled in the art will appreciate that various substitutions, omissions, modifications, and changes may be made without departing from the scope or spirit hereof. Accordingly, it is intended that the foregoing description be considered merely exemplary of the invention and not a limitation thereof.

What is claimed is:

1. A fabric-safe bleaching composition comprising an effective bleaching amount of a polymer coated halogenated glycoluril compound, wherein said halogenated glycoluril compound has the formula

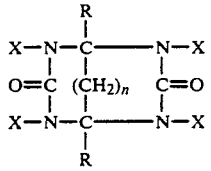

wherein each R is independently selected from hydrogen, $C_1$–$C_{10}$ straight or branched chain alkyl, aryl or alkyl substituted aryl; each X is independently selected from hydrogen, fluorine, chlorine, bromine and iodine and at least one X is not hydrogen and n is 0 or 1, said polymer coating being capable of hydrating and dissolving as a pH greater than 6.0.

2. The bleaching composition according to claim 1, wherein each R is hydrogen.

3. The bleaching composition according to claim 1, wherein the alkyl is methyl, ethyl or propyl.

4. The bleaching composition according to claim 1, wherein aryl is phenyl, naphthyl or benzyl.

5. The bleaching composition according to claim 1, wherein n is 0.

6. The bleaching composition according to claim 1, wherein each X is chlorine, each R is hydrogen, and n is 0.

7. The bleaching composition according to claim 1, wherein the polymer coating is capable of hydrating and dissolving at a pH between 7.2 and 11.0.

8. The bleaching composition according to claim 1, wherein the polymer coating is capable of hydrating and dissolving at a pH between 9.5 and 11.0.

9. The bleaching composition according to claim 1, wherein the polymer coating is selected from the group of polymers consisting of hydroxypropyl methylcellulose phthalate, polyvinyl acetate phthalate, acrylate polymers and cellulose acetate phthalate.

10. The bleaching composition according to claim 9, wherein the polymer coating is hydroxypropyl methylcellulose.

11. A fabric-safe bleaching and cleaning detergent composition comprising an effective cleaning amount of a bleach stable surfactant and an effective bleaching amount of a polymer coated halogenated glycoluril compound having the formula

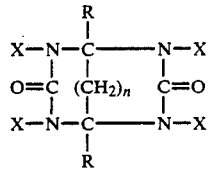

wherein each R is independently selected from hydrogen, $C_1$–$C_{10}$ straight or branched chain alkyl, aryl or alkyl substituted aryl; each X is independently selected from hydrogen, fluorine, chlorine, bromine and iodine and at least one X is not hydrogen and n is 0 or 1, said polymer coating being capable of hydrating and dissolving at a pH greater than 6.0.

12. The bleaching and cleaning detergent composition according to claim 11, wherein each R is hydrogen.

13. The bleaching and cleaning detergent composition according to claim 11, wherein the alkyl is methyl, ethyl or propyl.

14. The bleaching and cleaning detergent composition according to claim 11, wherein aryl is phenyl, naphthyl or benzyl.

15. The bleaching and cleaning detergent composition according to claim 11, wherein n is 0.

16. The bleaching and cleaning detergent composition according to claim 11, wherein each X is chlorine, each R is hydrogen and n is 0.

17. The bleaching and cleaning detergent composition according to claim 11, wherein the polymer coating is capable of hydrating and dissolving at a pH between 7.2 and 11.0.

18. The bleaching and cleaning detergent composition according to claim 17, wherein the polymer coating is capable of hydrating and dissolving at a pH between 9.5 and 11.0.

19. The bleaching and cleaning detergent composition according to claim 11, wherein the polymer coating is selected from the group of polymers consisting of hydroxypropyl methylcellulose phthalate, polyvinyl acetate phthalate, acrylate polymers and cellulose acetate phthalate.

20. The bleaching and cleaning detergent composition according to claim 19, wherein the polymer coating is hydroxypropyl methylcellulose.

21. The bleaching and cleaning detergent composition of claim 11, wherein the bleach stable surfactant is a soap or synthetic detergent active material selected from anionic, nonionic, cationic, zwitterionic, amphoteric materials or mixtures thereof.

22. The bleaching and cleaning detergent composition according to claim 11 further including binder.

23. A micelle comprising a bleach stable surfactant distributed around a halogenated glycoluril compound having the formula

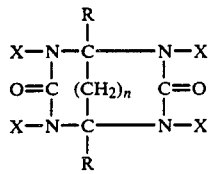

wherein each R is independently selected from hydrogen, $C_1$–$C_{10}$ straight or branched chain alkyl, aryl or alkyl substituted aryl; each X is independently selected from hydrogen, fluorine, chlorine, bromine and iodine and at least one X is not hydrogen and n is 0 or 1.

* * * * *